US005983402A

United States Patent [19]

Fincher

[11] Patent Number: 5,983,402

[45] Date of Patent: Nov. 16, 1999

[54] SOCK HAVING IMPROVED SORTING CHARACTERISTICS

[76] Inventor: Veronica S. Fincher, P.O. Box 2302, Cumming, Ga. 30128

[21] Appl. No.: 09/057,746

[22] Filed: Apr. 9, 1998

Related U.S. Application Data

[60] Provisional application No. 60/049,628, Jun. 13, 1997.

[51] Int. Cl.[6] ..... A41D 11/00

[52] U.S. Cl. ..... 2/239

[58] Field of Search ..... 2/239, 61, 240, 2/241, 242, 409, 66

[56] References Cited

U.S. PATENT DOCUMENTS

| | | | |
|---|---|---|---|
| 2,219,235 | 10/1940 | Morton | 2/239 |
| 2,569,434 | 9/1951 | Ischinger | 2/239 |
| 2,621,501 | 12/1952 | Jenkins | 2/239 |
| 2,980,917 | 4/1961 | Slane | 2/239 |
| 3,135,442 | 6/1964 | Carter, Jr. | 2/239 |
| 3,324,686 | 6/1967 | Rosenstein | 2/239 |
| 4,058,853 | 11/1977 | Boxer et al. | 2/239 |
| 4,096,655 | 6/1978 | Ullman, Jr. | 40/2 |
| 4,104,892 | 8/1978 | Thorneburg | 66/185 |
| 4,734,938 | 4/1988 | Anderson | 2/239 |
| 4,958,388 | 9/1990 | Madden, IIII | 2/239 |
| 5,357,660 | 10/1994 | Smith | 64/662 |
| 5,473,781 | 12/1995 | Greenberg | 2/239 |
| 5,579,541 | 12/1996 | Christy et al. | 2/239 |
| 5,586,341 | 12/1996 | Hill, Jr. | 2/239 |
| 5,617,745 | 4/1997 | Della Corte et al. | 2/239 |
| 5,708,984 | 1/1998 | Shofner | 2/239 |

*Primary Examiner*—Amy Vanatta
*Attorney, Agent, or Firm*—Thomas, Kayden, Horstemeyer & Risley, L.L.P.

[57] ABSTRACT

The present invention is directed to an improved pair of socks providing comfortable wear and enhanced sortability characteristics. In accordance with one aspect of the invention, a pair of socks is provided, wherein each sock further comprises a toe, an open end opposite to toe, and a heal portion formed between the toe and the open end. A colored identifying portion is disposed between the toe and the heal, wherein the color of the colored identifying portion is different than the color of the remaining foot portion of the sock. In addition, the invention includes an elastic band disposed between the toe and the heal, and extending at least part way around the foot portion of the sock. In the preferred embodiment, the elastic band is disposed at substantially the midpoint of the sock between the heal and the toe, and extends approximately halfway around the sock, over the top portion thereof.

6 Claims, 2 Drawing Sheets

SOCK HAVING IMPROVED SORTING CHARACTERISTICS

CROSS-REFERENCE TO RELATED APPLICATIONS

This application claims the benefit of U.S. Provisional Patent Application Ser. No. 60/049,628, filed Jun. 13, 1997, and entitled SORTABLE SOCK.

BACKGROUND OF INVENTION

1. Field of the Invention

The present invention generally relates to hosiery or leg apparel, and more particularly to socks or hosiery having indicia for identifying the color or other characteristic of the socks.

2. Discussion of the Related Art

The problem of sorting or other hosiery is well known. For example, in a family having several people including children, a relatively large number of socks may be washed in a single load of laundry. Furthermore, often several loads of laundry may be washed and dried before sorting the clothing to stow away. Often it is desired particularly when sorting laundry for multiple persons, to be able to match and sort socks in pairs. Unless the socks come with a preprinted pattern, the sorting process is often difficult. In similar fashion, it is common practice for people, especially children, to have a relatively large number of pairs of socks kept in a single drawer, in unsorted fashion. As noted above, it is often difficult to sort out a matching pair of socks without spending an excessive amount of time searching. This problem is compounded where there are more than one person's socks kept in a single drawer. Accordingly, it is desired to provide a sock having some type of marking indicia to help the sorting process, or otherwise facilitate the matching of mating pairs of socks.

One example as is known in the prior art is illustrated in U.S. Pat. No. 4,958,388. This patent discloses socks having size indicating stripes at the calf end of the stock. One stripe, for example, may indicate a short length sock, two stripes may indicate a medium length stock, and three stripes may indicate a full length sock.

Similarly, U.S. Pat. No. 4,734,938 to Anderson discloses a sock having identifying markings near the toe of the sock. As disclosed, this identifying marking may comprise a word, symbol or other description to identify the color of the sock, which may be particularly useful in poorly illuminated conditions. For example, when a person needs to find a matching pair of socks in a dimly lit room.

A disadvantage of the prior art, as particularly illustrated by the '388 patent, is that it is often desired not to have visible indicia (such as colored stripes). Therefore, the '388 patent having stripes near the calf end of the sock, results in visible (assuming the person is not wearing long pants) indicia on the sock.

Another shortcoming noted in the prior art relates to the tendency of socks to often slide off the foot of the person who is wearing them. Particularly, with children, socks often tend to slide off the feet, causing aggravation to the child and, often, lost socks.

Accordingly, what is desired is a sock having improved sorting characteristics and improved ability to remain on a foot.

SUMMARY OF INVENTION

Certain objects, advantages and novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the advantages and novel features, the present invention is generally directed to an improved pair of socks providing comfortable wear and enhanced sortability characteristics. In accordance with one aspect of the invention, a pair of socks is provided, wherein each sock further comprises a toe, an open end opposite to toe, and a heal portion formed between the toe and the open end. A colored identifying portion is disposed between the toe and the heal, wherein the color of the colored identifying portion is different than the color of the remaining foot portion of the sock. In addition, the invention includes an elastic band disposed between the toe and the heal, and extending at least part way around the foot portion of the sock. In the preferred embodiment, the elastic band is disposed at substantially the midpoint of the sock between the heal and the toe, and extends approximately halfway around the sock, over the top portion thereof.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENT

Figure 2:
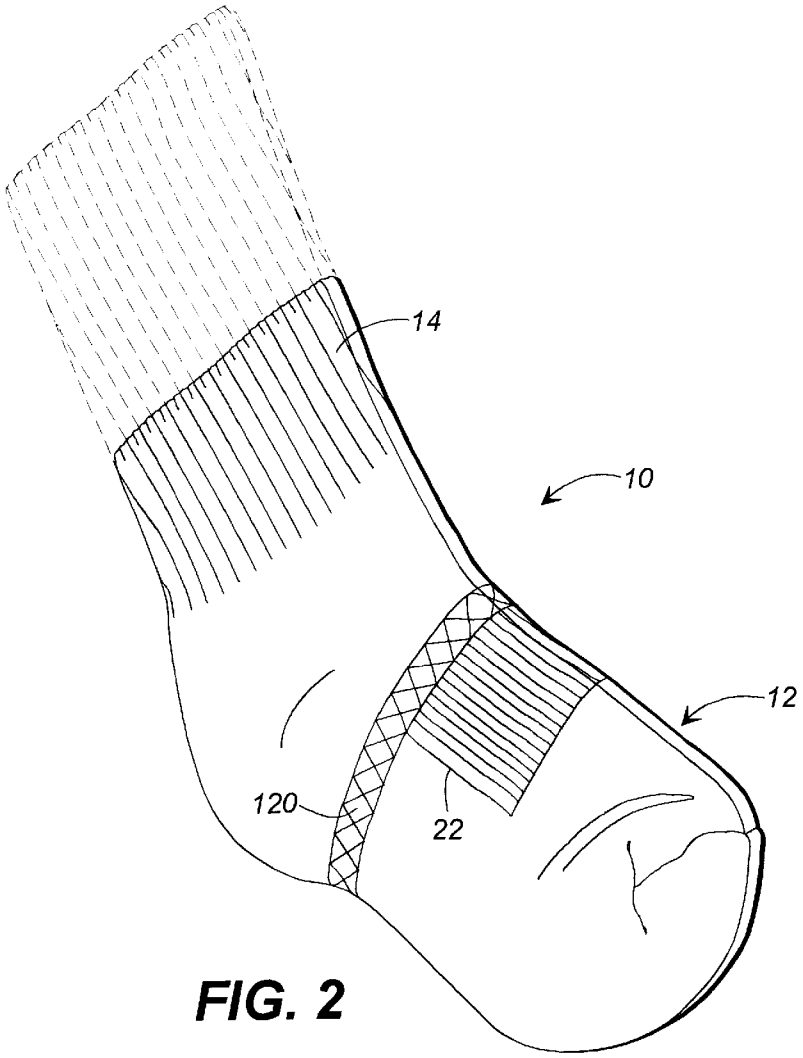
FIG. 2 is a side view of a sock constructed in accordance with an alternative embodiment of the present invention.

Having summarized the invention above, reference will now be made in detail to the description of the invention as illustrated in the drawings. While the invention will be described in connection with these drawings, there is no intent to limit the invention to the embodiment or embodiments disclosed therein. On the contrary, the intent is to cover all alternatives, modifications and equivalents included within the spirit and scope of the invention as defined by the appended claims.

Figure 1:
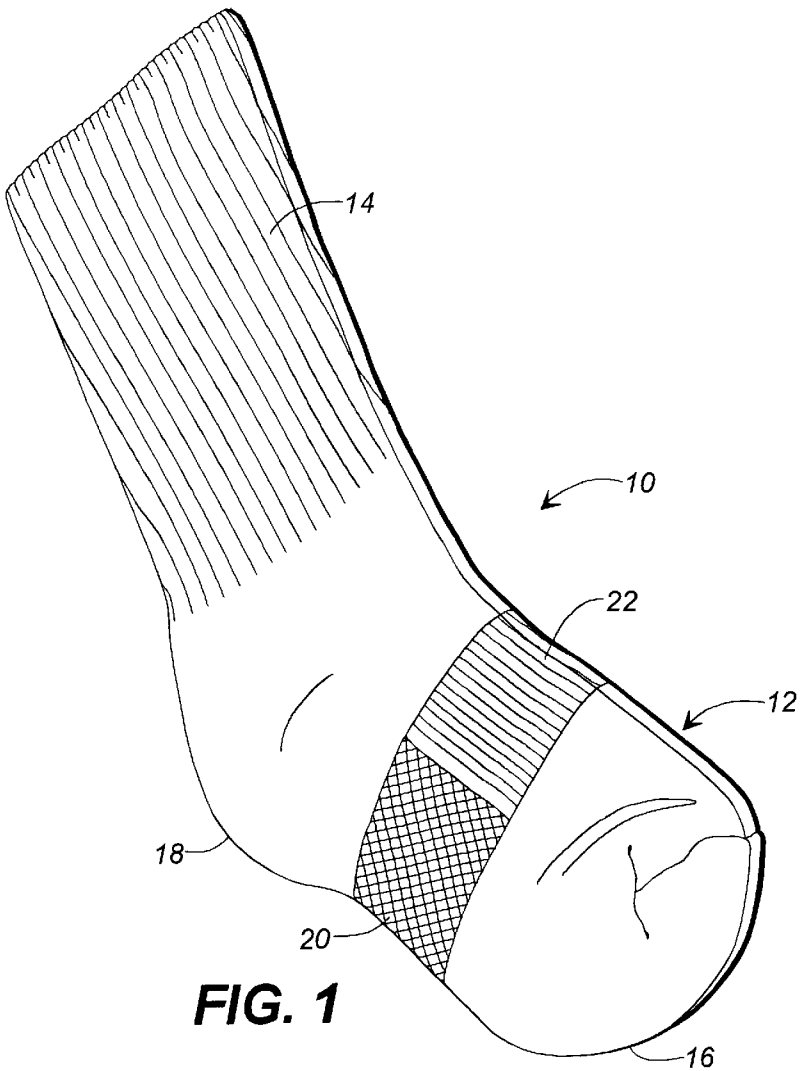
FIG. 1 is a side view of a sock constructed in accordance with the preferred embodiment of the present invention.

Turning now to the drawings, reference is made to FIG. 1, which illustrates a sock, generally designated by reference numeral 10, embodying the principals of the present invention. More specifically, the sock 10 comprises a foot portion 12 and a ribbed upper portion 14 extending therefrom. More particularly, the foot portion 12 is defined between a toe 16 and a heal 18. The ribbed portion 14 extends upwardly from the foot portion 12 to define a radially elastic portion to conformably grip the lower leg of the wearer.

Approximately midway between the toe portion 16 and the heal portion 18 of the foot portion 12, a colored identifying strip 20 is located. In the preferred embodiment, the colored identifying strip 20 extends around the lower half of the foot portion 12. It will be appreciated, however, that in accordance with the broader concepts in teachings of the present invention, the colored identifying strip 20 may be disposed at virtually any location along the foot portion 12. For purposes of the inventive concepts, it is important only that the colored identifying strip 20 be disposed in a location that will not be visible when the wearer places a shoe over his or her foot. In this regard, the colored identifying strip should not be disposed on the ribbed portion 14, but rather on the foot portion 12.

Preferably the colored identifying strip 20 will define a stark contrast in color between the strip 20 and the remainder of the foot portion 12 of the sock 10. Although the colored identifying strip may be embroidered or otherwise applied onto the foot portion 12 on the sock 10, it will preferably be woven within the fabric itself In accordance with another aspect of the present invention, an elastic, woven portion 22 extends about the upper half of the foot portion 12, coincident with the colored identifying strip 20 (i.e., midway between the toe 16 and heel 18). The elastic portion 22 may be formed of a particular ribbed weave so as to impart an elastic gripping action in a manner similar to the action of the ribbed upper potion 14. Alternatively, an elastic material may be woven into the material of the sock. In either event, the elastic strip 22 serves to grip the foot, although not so tightly as to cause discomfort, to aid in retaining the sock upon the foot. Particularly in the case of children, the elderly, or others that may have difficulty in retaining socks on their feet-particularly when walking around in socked feet-the elastic portion 22 provides significant enhancement to an otherwise ordinary sock.

While FIG. 1 has been shown to illustrate two aspects of the present invention in a particular, preferred embodiment, other embodiments of the inventive concepts may be realized as well. In this regard, reference is made briefly to FIG. 2 which illustrates the colored identifying strip 120 as completely encircling the foot portion 12 of the sock 10. It also illustrates the colored identifying strip 120 as being offset from the elastic portion 22. The ribbed upper portion 14 is illustrated in part in solid line and in part in dotted line, to illustrate that it may be a short length sock, or a longer length sock 10.

Figure 3:
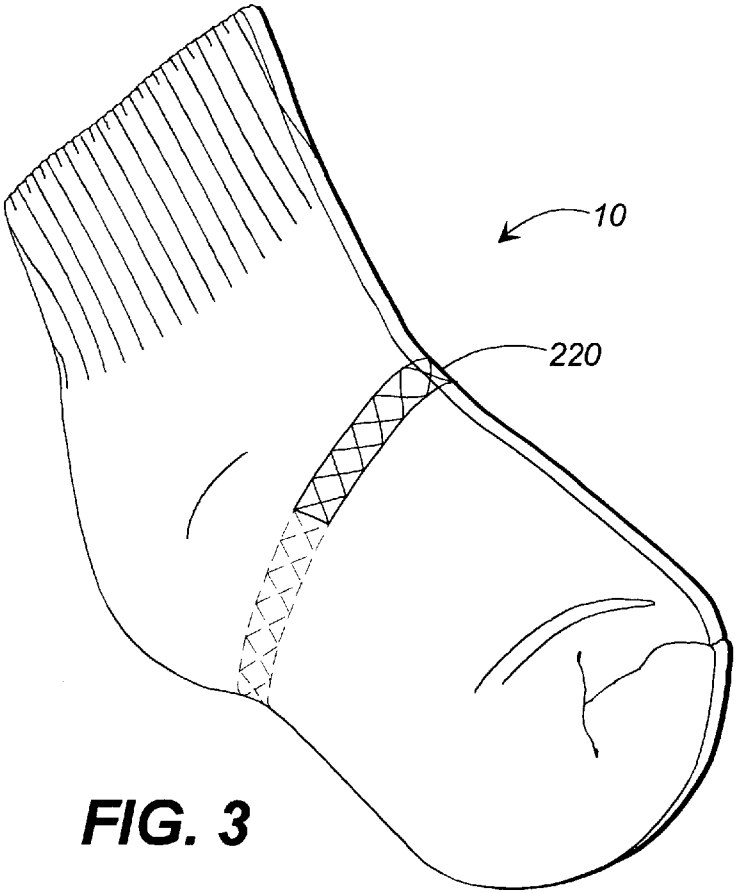
FIG. 3 is a side view of a sock constructed in accordance with another embodiment of the present invention.

Referring to FIG. 3, a sock 10 is shown having only a colored identifying strip 220. The colored identifying strip is illustrated as extending over the top portion of the sock 10. It is also illustrated, in dashed line, as extending about the bottom portion of the sock 10 as well. In this regard, it will be appreciated that it is largely irrelevant whether the colored identifying strip completely encircles the sock 10, or occupies only a portion of the foot portion thereof. For purposes of the inventive concepts, it is important only that the colored identifying strip clearly distinguish the sock. In this regard, in a household having, for example, three children, it may be desirable to effectively assign a unique color or colors to each child. For example, the oldest child may be assigned the color blue, and therefore all blue socks may be sorted and given to the older child. Similarly, all red socks may be given to the middle child, while all green socks may be given to the youngest child. In this way, when sorting laundry, or attempting mating pairs of socks from a dresser drawer, it is quite easy to identify appropriate, mating pairs.

Figure 4:
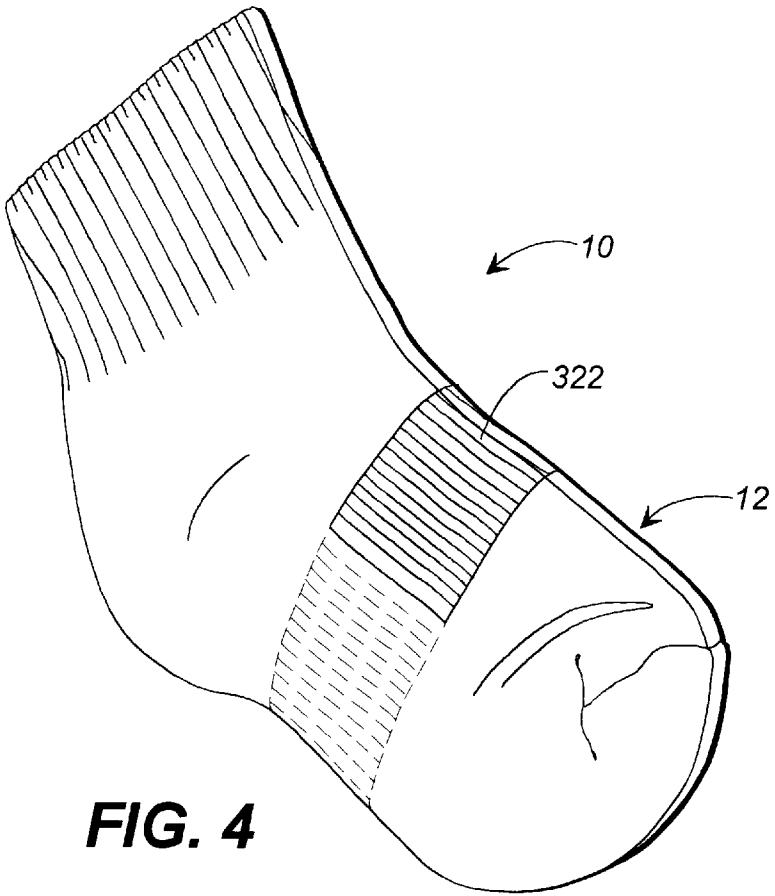
FIG. 4 is a side view of a sock constructed in accordance with still another embodiment of the present invention.

Referring now to FIG. 4, a sock 10 is shown having an elastic portion 322, but no colored identifying strip. As illustrated, the elastic portion 322 extends over the top portion of the foot portion 12 of the sock 10. As illustrated by dashed lines, the elastic portion 322 may extend to substantially, if not completely, encircle the foot portion 12 of the sock 10. In yet a further embodiment (not shown), the elastic portion may extend only around the bottom portion of the foot portion 12 of the sock 10.

It will be appreciated, that although the colored identifying strip may be located in virtually any location on the foot portion of the sock 12, the elastic strip will preferably be located near the midpoint of the sock, or certainly within the narrowing portion that exists between the heal 18 and ball of the foot.

Thus, the sock of the present invention provides easy sortability and stability and wear, and thus, overcomes at least two common problems of socks known in the prior art, especially those intended for wear by children.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A pair of socks each sock comprising:

a toe, an open end opposite the toe, and a heel formed between the toe and the open end;

an elastic band disposed between the toe and the heel, and extending over a top portion of the sock and at least half way around the sock; and a colored identifying portion in the form of a single band, disposed between the toe and the heel to align with the elastic band, the color of the colored identifying portion being different from the color of the sock and disposed to extend around a bottom portion of the sock, but extending only part way around the sock.

2. The pair of socks as defined in claim 1, wherein the colored identifying portion is integrally formed with a fabric of the sock.

3. The pair of socks as defined in claim 1, wherein the colored identifying portion comprises a separate material that is disposed adjacent, and attached to, a fabric forming the sock.

4. The pair of socks as defined in claim 1, wherein the elastic band extends approximately half-way around the sock.

5. The pair of socks as defined in claim 1, wherein the elastic band extends substantially all the way around the sock.

6. The pair of socks as defined in claim 1, wherein the elastic band is disposed at approximately mid-way between the toe and the heel.

* * * * *